US005286124A

United States Patent [19]

Tsutsumi

[11] Patent Number: 5,286,124

[45] Date of Patent: Feb. 15, 1994

[54] PLATEN KNOB

[75] Inventor: Yoshihiro Tsutsumi, Saga, Japan

[73] Assignee: Matsushita Electric Industrial Co., Ltd., Osaka, Japan

[21] Appl. No.: 913,915

[22] Filed: Jul. 17, 1992

[30] Foreign Application Priority Data

Jul. 18, 1991 [JP] Japan ..... 3-178020

[51] Int. Cl.[5] ..... B41J 11/04

[52] U.S. Cl. ..... 400/661; 400/661.3

[58] Field of Search ..... 400/661, 659, 661.1, 400/661.2, 661.3, 661.4, 690, 690.2, 690.3, 690.4, 689, 556, 556.2, 556.4, 557, 559, 559.1, 560, 560.1, 496, 567, 568

[56] References Cited

U.S. PATENT DOCUMENTS

| | | | |
|---|---|---|---|
| 924,606 | 6/1909 | Sokolov | 400/556 |
| 993,025 | 5/1911 | Buschmann | 400/557 |
| 1,057,365 | 3/1913 | Ursbruck | 400/559.1 |
| 2,580,285 | 12/1951 | Dobson | 400/560.1 |
| 4,279,525 | 7/1981 | Johnston | 400/656 |
| 4,618,278 | 10/1986 | Iwai | 400/568 |
| 4,710,046 | 12/1987 | Okubo | 400/556.2 |
| 5,018,886 | 5/1991 | Hiramatsu | 400/545 |

FOREIGN PATENT DOCUMENTS

| | | | |
|---|---|---|---|
| 0221837 | 5/1987 | European Pat. Off. | 400/661 |
| 0377033 | 6/1921 | Fed. Rep. of Germany | 400/559 |
| 657021 | 5/1936 | Fed. Rep. of Germany . | |
| 59-156772 | 9/1984 | Japan . | |
| 60-192670 | 10/1985 | Japan . | |
| 61-248762 | 11/1986 | Japan . | |
| 63-154377 | 6/1988 | Japan . | |
| 4-29865 | 1/1992 | Japan . | |

*Primary Examiner*—David A. Wiecking
*Assistant Examiner*—Anthony H. Nguyen
*Attorney, Agent, or Firm*—Pollock, Vande Sande & Priddy

[57] ABSTRACT

A platen knob includes a first hollow cylinder having one bottom wall, a second hollow cylinder extending from the interior surface of the bottom wall coaxially with the first cylinder. The second cylinder is fitted on a shaft of a cylindrical platen through a hollow boss of a casing housing the platen. A cavity defined between the sidewalls of the cylinders receives a vibration-proof lining and/or an acoustical layer. The lining suppresses a vibration of the platen knob. The acoustical layer seals the boss of the casing and leaks no noise from the interior of an electronic apparatus including a platen.

6 Claims, 6 Drawing Sheets

PLATEN KNOB

BACKGROUND OF THE INVENTION

1. Field of Invention Application

The present invention relates generally to a platen knob and more particularly to a platen knob suitable for use in electronic apparatuses such as an impact dot printer.

2. Description of the Related Art

The proportion of impact dot printers to printers is large and the impact dot printers are popular in offices. However, a printing noise by the impact dot printers has recently given rise to a trouble.

A prior-art impact dot printer will be described hereinafter. FIG. 8 is a perspective view of the prior-art impact dot printer. The printer is generally indicated at 50. An upper cabinet of the printer is indicated at 51. The printer 50 comprises a platen knob 52.

FIG. 9*a* illustrates a main part of the interior of the printer 50. A cylindrical platen 53 is journalled on a framework (not shown) within the upper cabinet 51. A paper feeder (not shown) feeds a printing paper 54 to the platen 53. The printing paper 54 is fitted on the cylindrical surface of the platen 53. A carriage guiding shaft 60 is supported on the framework and extends in parallel to the platen 53. A carriage 61 carrying an impact dot printer head 55 is slidably mounted on the carriage guiding shaft 60. The printer head 55 has a predetermined distance from the cylindrical surface of the platen 53. The carriage 61 carries an ink ribbon 56 covering the front edge 55*a* of the printer head 55 and is fastened to a drive belt 62. The drive belt 62 extends between a drive pulley 63 and a driven pulley 64 spaced from each other so that the carriage 61 can reciprocally travel across the length of the platen 53. The drive pulley 63 is mounted on the shaft 65*a* of a spacing motor 65. The torque of the spacing motor 65 is sequentially transmitted to the drive pulley 63, the drive belt 62 and the carriage 61 to move the carriage 61 in a spacing direction. An interior mechanism (not shown) of the carriage 61 transforms a movement of the carriage 61 along the carriage guiding shaft 60 to a rotation of an ink ribbon take-up shaft (not shown) to take up the ink ribbon 56. One end 53*b* of a shaft of the platen 53 has a spur gear 68 mounted thereon. The shaft 66*a* of a line feed motor 66 has a pinion 67 mounted thereon and meshing with the spur gear 68. The torque of the line feed motor 66 is sequentially transmitted to the pinion 67, the spur gear 68 and the platen 53 to rotate the platen 53.

The respective printer head 55, spacing motor 65 and line feed motor 66 are electrically connected to a control board 73 through a lead wire 70 from the printer head 55, a lead wire 71 from the spacing motor 65 and a lead wire 72 from the line feed motor 66. The control board 73 comprises a printer control device 74 performing a printing control of the printer head 55, a spacing control of the carriage 61 and a line feed control of the printing paper 54.

FIG. 9*b* is a sectional view of the knob 52 taken along the line Y—Y in FIG. 9*a*. The body of the knob 52 is essentially a bottomed hollow round cylinder. A central part of the interior surface of bottom wall 52*c* of the knob 52 has a fitting boss 52*a* extending inward of the printer 50. The fitting boss 52*a* is a double cylinder comprising a fitting inner cylinder 52*d*, a reinforcing outer cylinder 52*e*, and ribs (not shown) extending radially from the inner cylinder 52*d* to the outer cylinder 52*e*. The fitting boss 52*a* is fitted on an external end 53*a* of the shaft of the platen 53.

In operation, manually rotating the knob 52 rotates the shaft of the platen 53 and the platen 53. The manual rotation of the knob 52 also directly causes the paper feeder to feed the printing paper 54 in the direction of rotation of the platen 53. Thus, the printing paper 54 is positioned in the printer 50.

Then, supplying printing instructions to the printer 50 starts a series of operations of the printer 50. The printer 50 line feeds the printing paper 54 to a line of letters to be printed. The printer control device 74 controls the line feed motor 66 to sequentially transmit a torque to the pinion 67, the spur gear 68 and the platen 53 and finally rotate the platen 53. Thus, the paper feeder rotating together with the platen 53 line feeds the printing paper 54 to the line of letters to be printed.

The printer head 55 is then spacing-moved along the carriage guiding shaft 60 to the position of a column of letter to be printed. The printer control device 74 controls the spacing motor 65 to rotate the drive pulley 63 and move the drive belt 62 and the carriage 61 together along the carriage guiding shaft 60. The carriage 61, the printer head 55 and the ink ribbon 56 together travel along the carriage guiding shaft 60 to follow the spacing-movement.

The printer 50 then starts printing letters or the like. The printer control device 74 processes printing data of printing instructions to dot matrices constituting letters and supplies drive signals required for printing to the printer head 55. Thereby, predetermined dot pins (not shown) of the printer head 55 impact the printing paper 54 fitting on the platen 53 via the ink ribbon 56. The dot pins transfer an ink impregnated in the ink ribbon 56 to the printing paper 54 to print one column of a dot matrix constituting a letter on the printing paper 54.

The printer control device 74 then spacing-controls the printer head 55 and the ink ribbon 56 to move to a next column of the dot matrix. The printer control device 74 controls the printer head 55 to print the next column of the dot matrix on the printing paper 54. The printer 50 repeats the cycle of the above-described operations to print letters and further lines of letters. In this case, the ink ribbon 56 is taken up as the carriage 61 moves along the carriage guiding shaft 60, so that the impacting surfaces of the dot pins always receive a fresh part of the ink ribbon 56. When the printer 50 prints a next line of letters on the printing paper 54, the printer control device 74 controls the line feed motor 66 to rotate the platen 53 by an angle corresponding to one vertical spacing between adjacent lines of letters. The paper feeder feeds the printing paper 54 by the one vertical spacing so that the printer head 55 prints a new line of letters. Thus, the printer control device 74 repeats the cycle of the line feed control, the spacing control and the impact control to print on the overall sight of the printing paper 54.

When the printer having the above-described structure operates, the impacts by the dot pins finely vibrates the platen 53. This fine vibration propagates from the shaft of the platen 53 to the fitting boss 52 of the knob 52*a*. Since a component of the fine vibration and the natural vibration of the knob 52 depending on the shape of the bottom wall 52*c* of the knob 52 resonate to each other, the bottom wall 52*c* of the knob 52 constitutes a source of noise. In addition, a cavity defined between the fitting boss 52*a*, the outermost sidewall 52*b* and the bottom wall 52*c* of the knob 52 resonates to the fine vibration to increase noise. The cavity also serves as a passageway through which the impact sounds of the dot pins from the cylindrical surface of the platen 53 leak out of the upper cabinet 51. Therefore, measures for fitting the knob 52 on the end 53*a* of the shaft of the platen 53 via an elastic element have been taken. However, these measures cannot achieve a sufficient noise reduction.

SUMMARY OF THE INVENTION

An object of the present invention is to provide a platen knob which much reduces noise from an impact dot printer.

A platen knob of a first aspect of the present invention comprises a first hollow cylinder having one bottom wall, a second hollow cylinder extending from the inner surface of the bottom wall coaxially with the first hollow cylinder, the second hollow cylinder being capable of fitting on a shaft of a platen, and a reinforcing lining mounted to the inner surface of the bottom wall between the first and second hollow cylinders. The reinforcing lining primarily serves as a vibrationproof element.

A platen knob of a second aspect of the present invention comprises instead of the reinforcing lining an acoustical layer mounted to the first interior surface of the bottom wall between the first and second hollow cylinders, the acoustical layer being capable of a tight contact with the edge of a knob receiving opening in a casing of an electronic apparatus including a platen.

A platen knob of the third aspect of the present invention comprises in addition to the elements of the first aspect of the present invention an acoustical layer provided on a second interior surface of the reinforcing lining layer, the second interior surface being directed in the axial direction of the platen knob, and a sliding layer provided on a third interior surface of the acoustical layer, the third interior surface being directed in the axial direction of the platen knob, the sliding layer being capable of a tight contact with the edge of the knob receiving opening in the casing of the electronic apparatus including the platen.

When any one of the platen knobs is attached to the platen, the lining suppresses a vibration of the knob, or the acoustical layer is brought into tight contact with the edge of the opening in the casing to seal the opening and absorb a noise from the interior of the casing, or the sliding layer reduces a friction between the edge of the opening and the acoustical layer while maintaining the sealing and acoustical effects by the acoustical layer.

DESCRIPTION OF THE PREFERRED EMBODIMENTS

Preferred embodiments of the present invention will be described with reference to the drawings hereinafter.

Figure 1A:
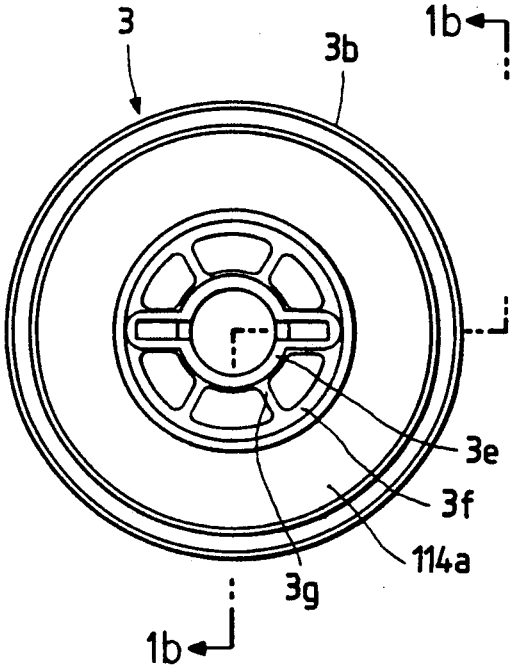
FIG. 1*a* is an enlarged front elevation of a platen knob according to a first embodiment of the present invention.
Figure 1B:
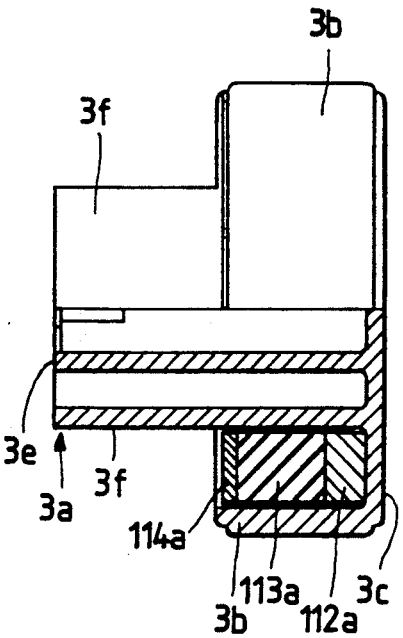
FIG. 1*b* is a sectional view of the knob taken along the line A—A in FIG. 1*a;*

FIG. 1*a* is an enlarged front elevation of a platen knob 3 according to a first embodiment of the present invention. The body (i.e. first hollow cylinder) of the knob 3 is in the form of bottomed round hollow cylinder. A central part of the interior surface of the bottom wall 3*c* of the knob 3 has a fitting hollow boss (i.e. second hollow cylinder) 3*a* extending therefrom in the axial direction of the knob 3. The fitting boss 3*a* has the structure of a double cylinder comprising an inner cylinder 3*e* fitting on an end 4*a* of a shaft of a platen 4, a reinforcing outer cylinder 3*f*, and ribs 3*g* radially extending between the inner cylinder 3*e* and the outer cylinder 3*f*. The knob 3 is generally made of a synthetic resin or plastic material. The overall interior surface of the bottom wall 3*c* between the fitting boss 3*a* and an outermost sidewall 3*b* of the knob 3 has a reinforcing lining 112*a* bonded thereto by an adhesive. The lining 112*a* is made of a material, e.g., steel sheet or lead sheet, heavier than the material of the knob 3. The lining 12*a* may be made of not only a metal but also a synthetic resin including lead. The overall interior surface (the left-hand surface in FIG. 1*b*) of the lining 112*a* has an annular acoustical layer 113*a* made of an acoustical material and bonded thereto by an adhesive. The acoustical layer 113*a* which has been bonded to the lining 112*a* has such a thickness that the axial position of the interior surface (the left-hand surface in FIG. 1*b*) of the acoustical layer 113*a* slightly does not reach the axial position of the interior edge surface of the outermost sidewall 3*b* of the knob 3. The acoustical layer 113*a* is made of, e.g., a plastic foam such as polyurethane foam, polyolefine foam or polystyrene foam.

The overall interior surface of the acoustical layer 113a has a sliding layer 114a bonded thereto by an adhesive. The sliding layer 114a is made with, e.g., polyester sheet or polyolefine sheet. In the first embodiment of the present invention, the sliding layer 114a is separate from the acoustical layer 113a. However, the interior surface of the acoustical layer 113a may have a skin of polyester superposed thereon instead of the sliding layer 114a.

Figure 2A:
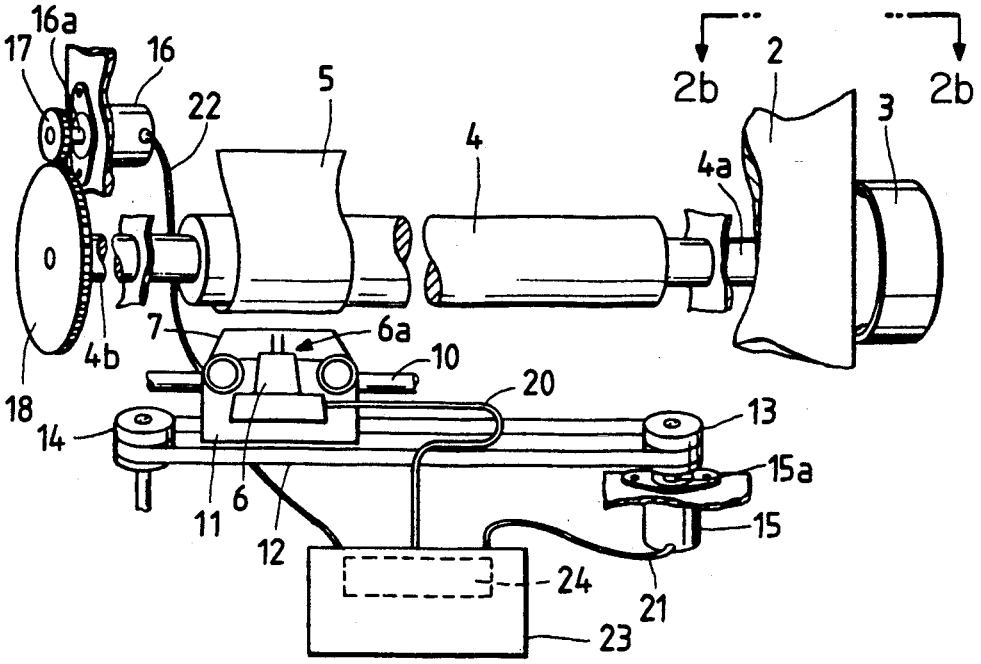
FIG. 2*a* is a cutaway perspective view of a main part of an impact dot printer, showing the knob of FIG. 1 fitting on a shaft of the platen.

FIG. 2a is a cutaway perspective view of a main part of the printer with the knob 3 mounted to the platen 4.

A cylindrical platen 4 is journalled on a framework (not shown) within the upper cabinet 2. A paper feeder (not shown) feeds a printing paper 5 to the platen 4. The printing paper 5 is fitted on the cylindrical surface of the platen 4. A carriage guiding shaft 10 is supported on the framework and extends in parallel to the platen 4. A carriage 11 carrying an impact dot printer head 6 is slidably mounted on the carriage guiding shaft 10. The printer head 6 has a predetermined distance from the cylindrical surface of the platen 4. The carriage 11 carries an ink ribbon 7 covering the front edge 6a of the printer head 5 and is fastened to a drive belt 12. The drive belt 12 extend between a drive pulley 13 and a driven pulley 14 spaced from each other so that the carriage 11 can reciprocally travel across the length of the platen 4. The drive pulley 13 is mounted on the shaft 15a of a spacing motor 15. The torque of the spacing motor 15 is sequentially transmitted to the drive pulley 13, the drive belt 12 and the carriage 11 to move the carriage 11 in a spacing direction. An interior mechanism (not shown) of the carriage 11 transforms a movement of the carriage 11 along the carriage guiding shaft 10 to a rotation of an ink ribbon take-up shaft (not shown) to take up the ink ribbon 7. One end 4b of a shaft of the platen 4 has a spur gear 18 mounted thereon. The shaft 16a of a line feed motor 16 has a pinion 17 mounted thereon and meshing with the spur gear 18. The torque of the line feed motor 16 is sequentially transmitted to the pinion 17, the spur gear 18 and the platen 4 to rotate the platen 4.

The respective printer head 6, spacing motor 15 and line feed motor 16 are electrically connected to a control board 23 through a lead wire 20 from the printer head 6, a lead wire 21 from the spacing motor 15 and a lead wire 22 from the line feed motor 16. The control board 23 comprises a printer control device 24 performing a printing control of the printer head 6, a spacing control of the carriage 11 and a line feed control of the printing paper 5.

Figure 2B:
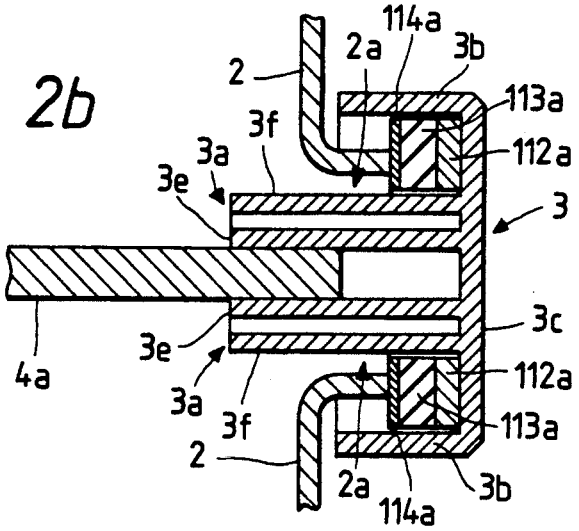
FIG. 2*b* is a sectional view of a junction of the knob, the platen shaft and an upper cabinet taken along the line X—X in FIG. 2*a;*

FIG. 2b is a sectional view of the knob 3 taken along the line X—X in FIG. 2a. The fitting boss 3a of the knob 3 is fitted on the external end 4a of the shaft of the platen 4 so that the outermost sidewall 3b of the knob 3 overlaps an annular mesa-shaped boss 2a of the upper cabinet 2 extending outwardly of the upper cabinet 2 and having an open external end and so that the outermost edge surface of the boss 2a of the upper cabinet 2 is in tight contact with the acoustical layer 113a via the sliding layer 114a. The boss 2a of the upper cabinet 2 compresses the acoustical layer 113a to reduce the thickness of the acoustical layer 113a, as shown in FIG. 2b.

Figure 9A:
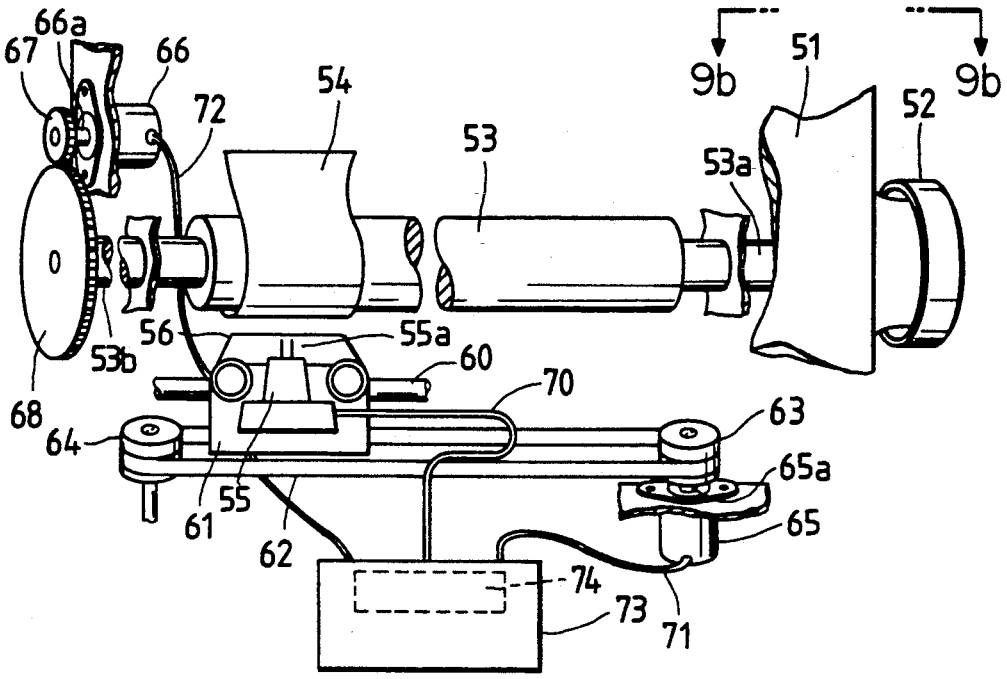
FIG. 9a PRIOR ART
FIG. 9*a* is a cutaway perspective view of a main part of the printer of FIG. 8, showing a prior-art knob fitting on a shaft of the platen.
Figure 9B:
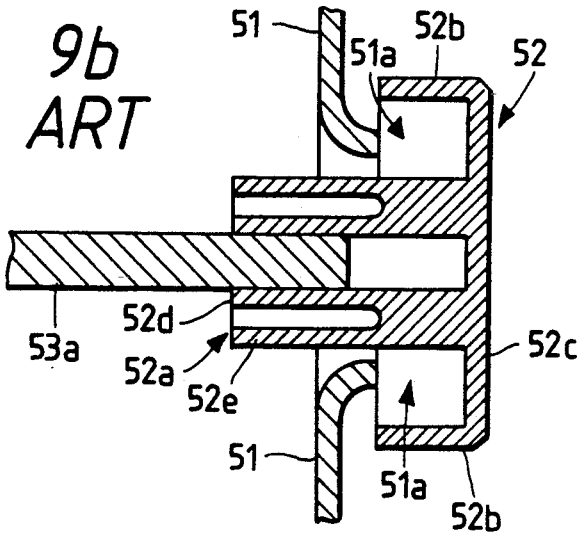
FIG. 9b PRIOR ART
FIG. 9*b* is a sectional view of a junction of the knob, the platen shaft and an upper cabinet taken along the line Y—Y in FIG. 9*a*.

The printing operation of the impact dot printer having the platen knob 3 according to the first embodiment is identical to that of the conventional impact dot printer shown in FIG. 9a.

The noise reduction in printing of the knob 3 will be described hereinafter. As described above, impacts by the dot pins of the printer head 6 finely vibrate the platen 4. This fine vibration of the platen 4 propagates throughout the knob 3 via the shaft of the platen 4 and the fitting boss 3a of the knob 3. The lining 112a reinforces the bottom wall 3c of the knob 3 and suppresses a vibration of the knob 3. The lining 112a also adds a mass to the mass of the bottom wall 3c of the knob 3 to change the frequency of the natural vibration of the bottom wall 3c of the knob 3. Thus, the bottom wall 3c of the knob 3 does not resonate to the fine vibration from the platen 4. Consequently, a high noise-reduction and a good assemblability of the knob 3 are obtained as clearances between the fitting boss 3a and the lining 112a and between the outermost sidewall 3b of the knob 3 and the lining 112a are reduced. On the other hand, the impact sounds from the cylindrical surface of the platen 4 by the dot pins propagate through the interior of the printer to the boss 2a of the upper cabinet 2. Since the outermost sidewall 3b of the knob 3 which has been fitted on the external end 4a of the shaft of the platen 4 overlaps the boss 2a of the upper cabinet 2, the outermost edge surface of the boss 2a of the upper cabinet 2 is in tight contact with the acoustical layer 113a. Since the acoustical layer 113a is compressed to reduce its thickness when the acoustical layer 113a is made of the plastic foam, the acoustical layer 113a maintains the tight contact with the boss 2a of the upper cabinet 2 by the elasticity of the plastic foam to increase an effect of sealing the interior of the upper cabinet 2. The plastic foam of the acoustical layer 113a includes a great number of foam grains, so that it has a high effect of absorbing noise. Thus, the impact sounds by the dot pins do not leak outside the upper cabinet 2. The lining 112a and the acoustical layer 113a are positioned in the cavity within sidewall 3b so that the knob 3 cannot resonate to the fine vibration from the platen 4.

However, the above-described arrangement of the knob 3 may involve a drawback that a very tight contact of the acoustical layer 113a with the boss 2a of the upper cabinet 2 increases a sliding friction between the acoustical layer 113a and the outermost edge surface of the boss 2a of the upper cabinet 2 during rotation of the platen 4. In the first embodiment, the sliding layer 114a reduces the sliding friction between the acoustical layer 113a and the outermost edge surface of the boss 2a of the upper cabinet 2 while maintaining the effects of the acoustical layer 113a sealing the boss 2a of the upper cabinet 2 and absorbing the noise from the interior of the printer. The sliding layer 114a also well protects the acoustical layer 113a from being worn.

Figure 3A:
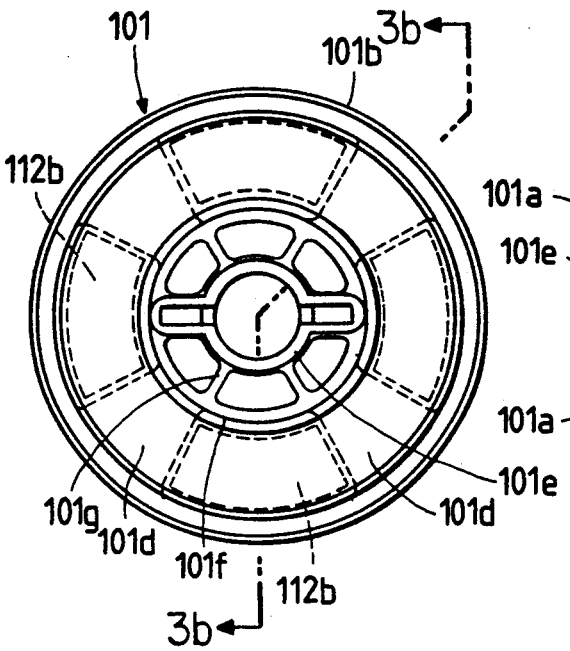
FIG. 3*a* is an enlarged front elevation of a platen knob according to a second embodiment of the present invention.
Figure 3B:
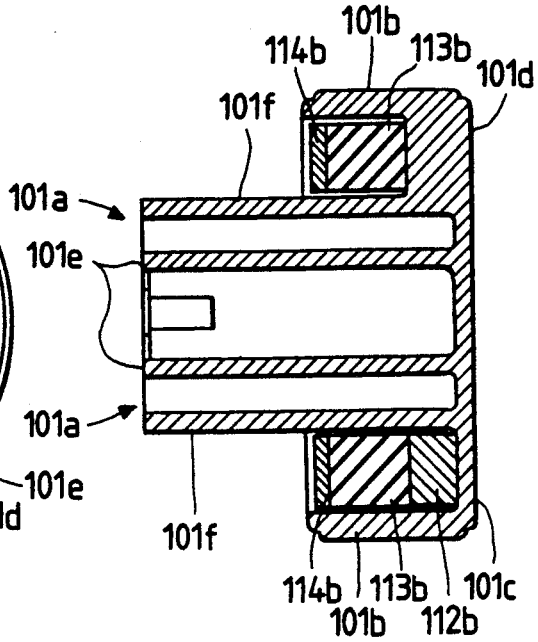
FIG. 3*b* is a sectional view of the knob taken along the line B—B in FIG. 3*a;*

FIGS. 3a and 3b illustrate a knob 101 suitable for use in small, low-speed impact dot printer according to a second embodiment of the present invention. The knob 101 is similar to the knob 3 according to the first embodiment and differs from the knob 3 in that the interior surface of a bottom wall 101c of the knob 101 has a plurality (four in FIG. 3) of sector-shaped separators 101d angularly spaced from one another and spreading between a fitting boss 101a and an outermost sidewall 101b of the knob 101 and in that spacings between the separators 101d receive linings 112b bonded to the interior surface of the bottom wall 101c of the knob 101. The size of each lining 112b is appropriately selected by the size of the printer.

A noise reduction by the knob 101 having the above-described structure is essentially equal to that of the knob 3 according to the first embodiment. In particular, since a vibration of the platen 4 is accordingly small when the impact dot printer is small and low-speed, the knob 101, which comprises angularly spaced linings 112*b*, achieves a sufficient noise reduction. The knob 101 also more reduces the inertia of the platen 4 than the knob 3 according to the first embodiment to reduce the required electric power and the size of the line feed motor 15. The linings 112*b* are preferably spaced in a rotational symmetry with respect to the axis of the knob 101 so as to avoid an eccentric center of gravity of the knob 101 for a smooth rotation of the platen 4. Materials for the linings 112*b*, the acoustical layers 113*b* and the sliding layers 114*b* in the second embodiment, of course, are identical to those in the first embodiment.

Figure 4A:
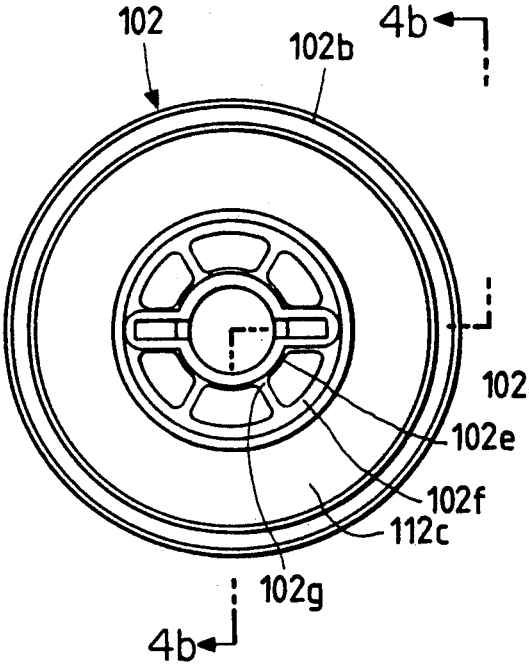
FIG. 4*a* is an enlarged front elevation of a platen knob according to a third embodiment of the present invention.
Figure 4B:
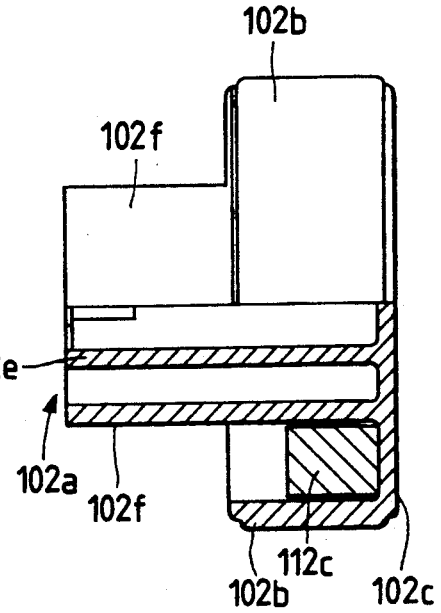
FIG. 4*b* is a sectional view of the knob taken along the line C—C in FIG. 4*a;*

FIGS. 4*a* and 4*b* show a platen knob 102 according to a third embodiment of the present invention primarily adapted for a vibrationproof use.

The knob 102 has essentially the same arrangement as the knob 3 according to the first embodiment and differs from the knob 3 in that a lining 112*c* has a larger thickness than the lining 112*a* of the knob 3 and in that the knob 102 comprises neither an acoustical layer nor a sliding layer on the acoustical layer. The body of the knob 102 is in the form of bottomed round hollow cylinder. A central part of the interior surface of the bottom wall 102*c* of the knob 102 has a fitting hollow boss 102*a* extending therefrom in the axial direction of the knob 102. The fitting boss 102*a* has the structure of a double cylinder comprising an inner cylinder 102*e* fitting on the shaft 4*a* of the platen 4, a reinforcing outer cylinder 102*f*, and ribs 102*g* radially extending between the inner cylinder 102*e* and the outer cylinder 102*f*. The knob 102 is generally made of a synthetic resin or plastic material. The interior surface of an annular portion of the bottom wall 102*c* of the knob 3 has a reinforcement lining 112*c* bonded thereto by an adhesive. The lining 112*c* is made of a material, e.g., steel sheet or lead sheet, heavier than the material of the knob 102. The lining 112*c* may be made of not only a metal but also a synthetic resin including lead.

The noise reduction in printing of the knob 102 will be described hereinafter. As described above, impacts by the dot pins of the printer head 6 finely vibrate the platen 4. This fine vibration of the platen 4 propagates throughout the knob 102 via the shaft of the platen 4 and the fitting boss 102*a* of the knob 102. The lining 112*c* reinforces the bottom wall 102*c* of the knob 102 and suppresses a vibration of the knob 102. The lining 112*c* also adds a mass to the mass of the bottom wall 102*c* of the knob 102 to change the frequency of the natural vibration of the bottom wall 102*c* of the knob 102. Thus, the bottom wall 102*c* of the knob 102 does not resonate to the fine vibration from the platen 4. Consequently, a high noise-reduction and a good assemblability of the knob 102 are obtained as clearances between the fitting boss 102*a* and the lining 112*c* and between the outermost sidewall 102*b* of the knob 102 and the lining 112*c* are reduced. On the other hand, the impact sounds by the dot pins from the cylindrical surface of the platen 4 propagate through the interior of the printer to the boss 2*a* of the upper cabinet 2. Since the lining 112*c* reduces an annular cavity defined between the fitting boss 102*a*, the outermost sidewall 102*b* and the bottom wall 102*c* of the knob 102, the knob 102 does not resonate to a noise.

Figure 5A:
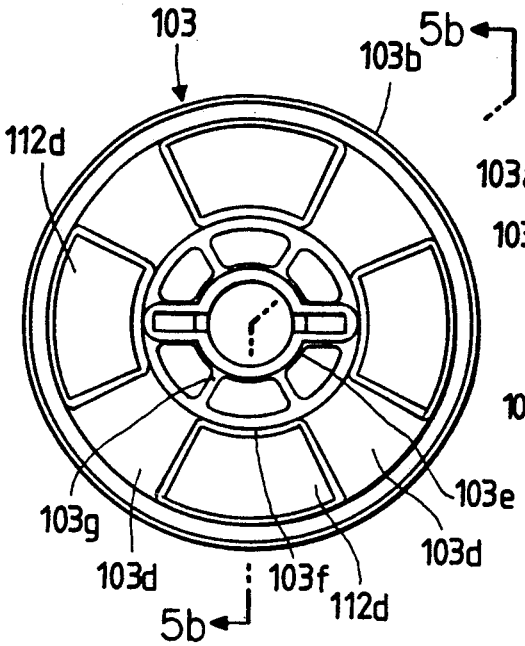
FIG. 5*a* is an enlarged front elevation of a platen knob according to a fourth embodiment of the present invention.
Figure 5B:
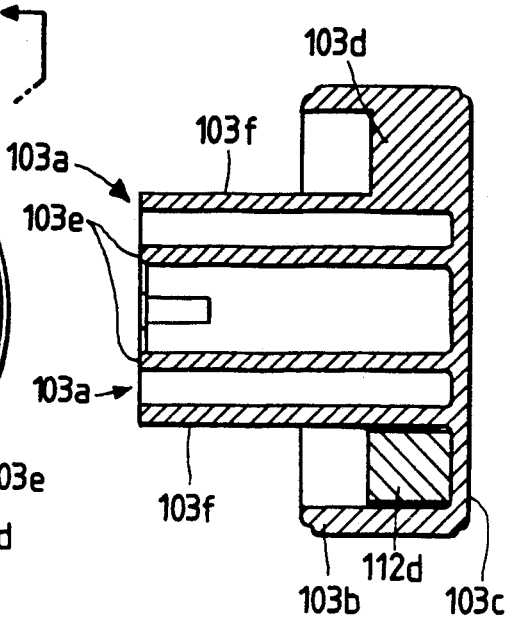
FIG. 5*b* is a sectional view of the knob taken along the line D—D in FIG. 5*a;*

FIGS. 5*a* and 5*b* illustrate a primarily acoustical knob 103 suitable for use in small, low-speed impact dot printers according to a fourth embodiment of the present invention. The knob 103 is similar to the knob 102 according to the third embodiment and differs from the knob 102 in that the interior surface of a bottom wall 103*c* of the knob 103 has a plurality (four in FIG. 5) of sector-shaped separators 103*d* angularly spaced from one another and spreading between a fitting boss 103*a* and an outermost sidewall 103*b* of the knob 103 and in that spacings between the separators 103*d* receive linings 112*d* bonded to the interior surface of the bottom wall 103*c* of the knob 103. The size of each lining 112*d* is appropriately selected by the size of the printer.

A noise reduction by the knob 103 having the above-described structure is essentially equal to that of the knob 102 according to the third embodiment. In particular, since a vibration of the platen 4 is accordingly small when the impact dot printer is small and low-speed, the knob 103, which comprises angularly spaced linings 112*d*, has a sufficient noise reduction. The knob 103 also more reduces the inertia of the platen 4 than the knob 102 according to the third embodiment to reduce a required electric power and the size of the line-feed motor 15. The linings 112*d* are preferably spaced in a rotational symmetry with respect to the axis of the knob 103 so as to avoid an eccentric center of gravity of the knob 103 for a smooth rotation of the platen 4. A material for the linings 112*d*, of course, is identical to that in the third embodiment.

Figure 6A:
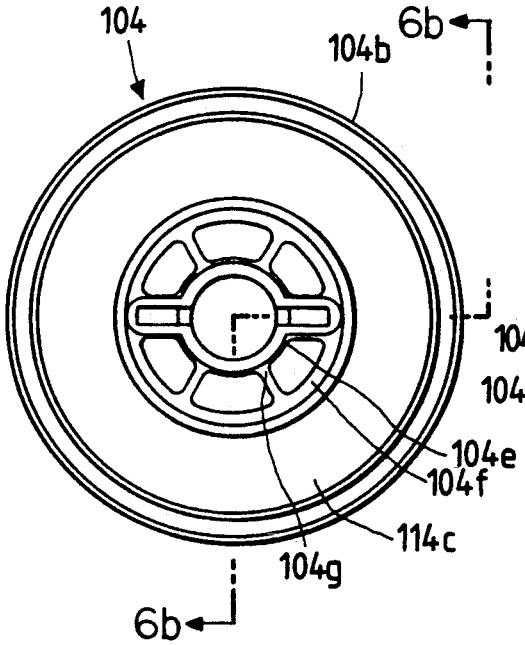
FIG. 6*a* is an enlarged front elevation of a platen knob according to a fifth embodiment of the present invention.
Figure 6B:
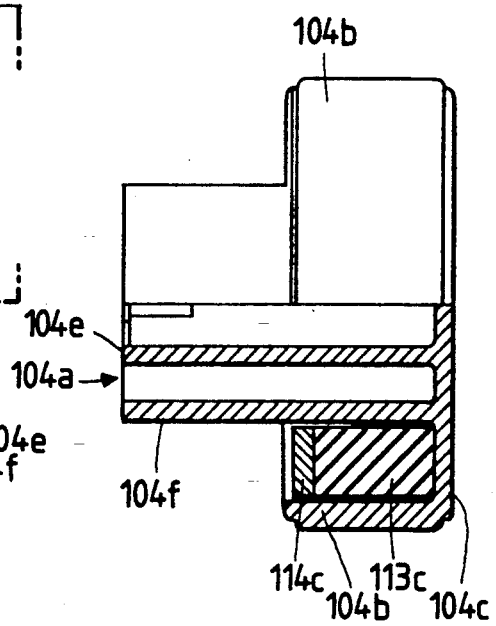
FIG. 6*b* is a sectional view of the knob taken along the line E—E in FIG. 6*a;*

FIGS. 6*a* and 6*b* illustrate a primarily acoustical knob 104.

The body of the knob 104 is in the form of bottomed round hollow cylinder. A central part of the interior surface of the bottom wall 104*c* of the knob 104 has a fitting hollow boss 104*a* extending therefrom in the axial direction of the knob 104. The fitting boss 104*a* has the structure of a double cylinder comprising an inner cylinder 104*e* fitting on the one end 4*a* of the shaft of a platen 4, a reinforcing outer cylinder 104*f*, and ribs 104*g* radially extending between the inner cylinder 104*e* and the outer cylinder 104*f*. The knob 104 is generally made of a synthetic resin or plastic material.

The interior surface of an annular portion of the bottom wall 104*c* of the knob 104 has an acoustical layer 113*c* bonded thereto by an adhesive. The acoustical layer 113*c* which has been bonded to the interior surface the bottom wall 104*c* of the knob 104 has such a thickness that the axial position of the left-hand surface of the acoustical layer 113*c* does not reach the axial position of the interior edge surface of the outermost sidewall 104*b* of the knob 104. The acoustical layer 113*c* is made of, e.g., a plastic foam such as polyurethane foam, polyolefine foam or polystyrene foam.

The overall interior surface of the acoustical layer 113*c* has a sliding layer 114*c* bonded thereto by an adhesive. The sliding layer 114*c* is made with, e.g., polyester sheet or polyolefine sheet. In the fifth embodiment, the sliding layer 114*c* is separate from the acoustical layer 113*c*. However, the interior surface of the acoustical layer 113*c* may have a skin of polyester superposed thereon instead of the sliding layer 114*c*.

The noise reduction in printing of the knob 104 will be described hereinafter. The impact sounds from the cylindrical surface of the platen 4 by the dot pins propagate through the interior of the printer to the boss 2*a* of the upper cabinet 2. Since the outermost sidewall 104*b* of the knob 104 which has been fitted on the external end 4*a* of the shaft of the platen 4 overlaps the boss 2*a* of the upper cabinet 2, the outermost edge surface of the boss 2a of the upper cabinet 2 is in tight contact with the acoustical layer 113c. Since the acoustical layer 113c is compressed to reduce its thickness when the acoustical layer 113c is made of the plastic foam, the acoustical layer 113c maintains the tight contact with the boss 2a of the upper cabinet 2 by the elasticity of the plastic foam to increase an effect of sealing the interior of the upper cabinet 2. The plastic foam of the acoustical layer 113c includes a great number of foam grains, so that it has a high effect of absorbing noise. Thus, the impact sounds by the dot pins do not leak outside the upper cabinet 2. The acoustical layer 113c and the sliding layer 114 fill the cavity defined between the fitting boss 104a, the outermost sidewall 104b and the bottom wall 104c of the knob 104, so that the knob 104 cannot resonate to the fine vibration from the platen 4.

However, the above-described arrangement of the knob 104 may involve a drawback that a very tight contact of the acoustical layer 113c with the boss 2a of the upper cabinet 2 increases a sliding friction between the acoustical layer 113c and the outermost edge surface of the boss 2a of the upper cabinet 2 during rotation of the platen 4. In the fifth embodiment, the sliding layer 114c reduces the sliding friction between the acoustical layer 113c and the outermost edge surface of the boss 2a of the upper cabinet 2 while maintaining the effects of the acoustical layer 113c sealing the boss 2a of the upper cabinet 2 and absorbing the noise from the interior of the printer. The sliding layer 114c also well protects the acoustical layer 113c from being worn.

Figure 7A:
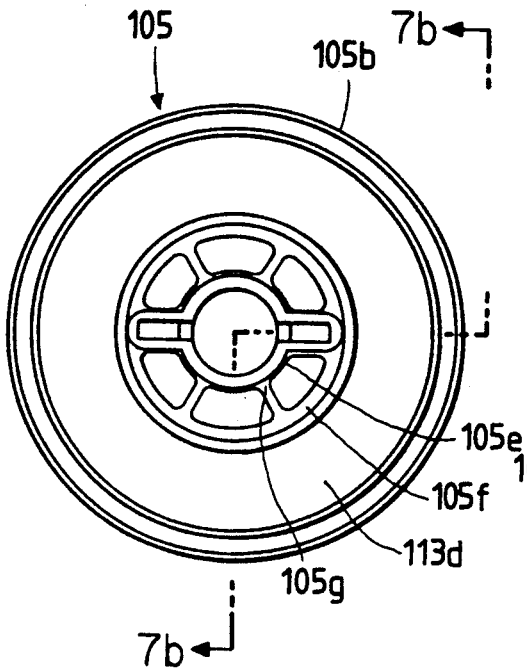
FIG. 7*a* is an enlarged front elevation of a platen knob according to a sixth embodiment of the present invention.
Figure 7B:
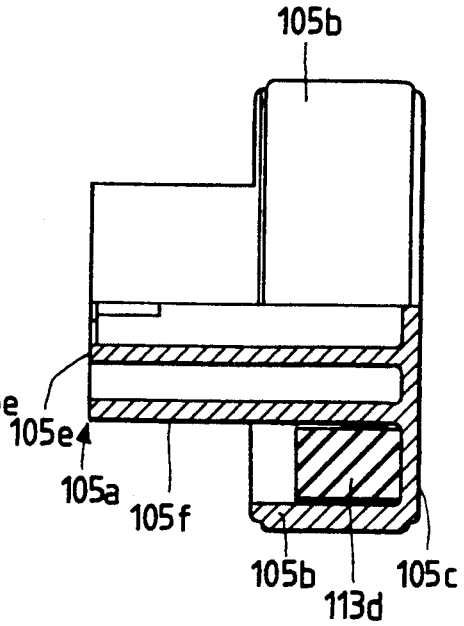
FIG. 7*b* is a sectional view of the knob taken along the line F—F in FIG. 7*a;*
Figure 8:
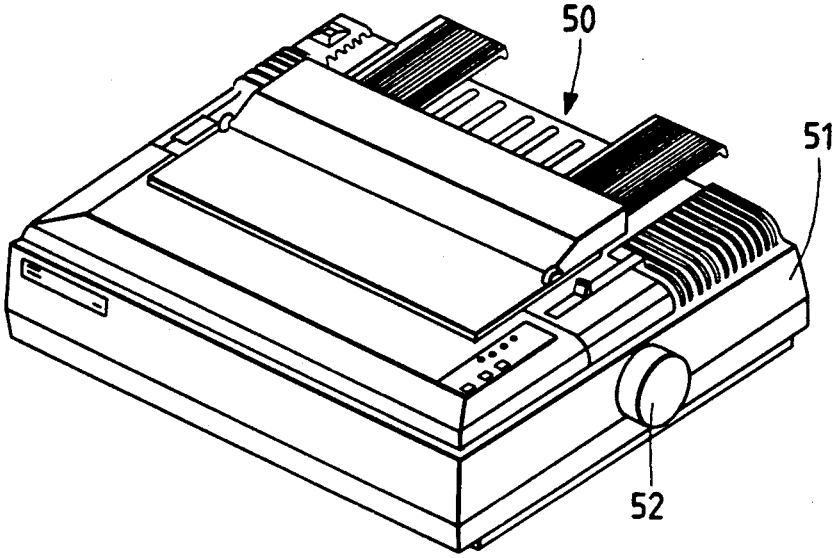
FIG. 8 PRIOR ART
FIG. 8 is a perspective view of a prior-art impact dot printer.

FIGS. 7a and 7b show a primarily acoustical knob 105 according to a sixth embodiment of the present invention. The knob 105 is similar to the knob 104 according to the fifth embodiment and differs from the knob 104 in that an acoustical layer 113d has such a thickness that the acoustical layer 113d is in light contact with the outermost edge surface of the boss 2a of the upper cabinet 2 when the knob 105 is fitted on the end 4a of the shaft of the platen 4 and in that the knob 105 lacks a sliding layer on the interior surface of the acoustical layer 113d. The knob 105 is suitable for use in a small, low-speed impact dot printer producing a low noise and a small vibration.

The noise reduction of the knob 105 is essentially identical to that of the knob 104 according to the fifth embodiment. That is, the acoustical layer 113d seals the boss 2a to prevent a noise from leaking out of the upper cabinet 2. The plastic foam of the acoustical layer 113d includes a great number of foam grains, the acoustical layer 113d has a high effect of absorbing noise. The acoustical layer 113d is located within sidewall 105b of the knob 105, so that the knob 105 does not resonate to a noise from the interior of the printer. In addition, the acoustical layer 113d is in light contact with the boss 2a of the upper cabinet 2, so that the lacking of the sliding layer does not increase a sliding friction between the boss 2a of the cabinet 2 and the acoustical layer 113d when the platen 4 rotates.

What is claimed is:

1. A platen knob, comprising:

a first hollow cylinder having a bottom wall;

a second hollow cylinder extending from an interior surface of said bottom wall coaxially with said first hollow cylinder, said second cylinder being capable of being mounted on a shaft of a rotatable roller-shaped platen;

a layer of a reinforcing lining bonded to said interior surface of said bottom wall between said first and second hollow cylinders, said interior surface of said bottom wall being coaxial with the platen knob, the reinforcing lining being made of a material, the specific gravity of which is higher than that of the material of said hollow cylinders;

a sound absorbing layer provided on an interior surface of said layer of the reinforcing lining layer, said interior surface of said layer of the reinforcing lining being coaxial with the platen knob; and a sliding layer provided on an interior surface of said sound absorbing layer, said interior surface of said sound absorbing layer being coaxial with the platen knob.

2. The platen knob as recited in claim 1, wherein said layer of the reinforcing lining comprises sections spaced from one another.

3. The platen knob as recited in claim 1, wherein the material for said reinforcing lining is selected from the group consisting of steel, lead and a synthetic resin including lead.

4. The platen knob as recited in claim 1, wherein said sound absorbing layer is made of a plastic foam.

5. A dot printer, comprising:

a rotatable roller-shaped platen on which a printing paper is fitted;

an impact dot printer head impacting the printing paper which has been fitted on said platen;

a knob mounted to a shaft of said platen;

a casing housing said platen and said impact dot printer head, said casing including an outwardly projecting hollow boss and having an external open end, the boss receiving a part of said knob; and said knob comprising a first hollow cylinder having a bottom wall, a second hollow cylinder extending from an interior surface of said bottom wall coaxially with the first hollow cylinder, said interior surface of said bottom wall being coaxial with the knob, the second hollow cylinder being capable of being mounted on the shaft of said platen, and a layer of a reinforcing lining bonded to said interior surface of said bottom wall between said first and second hollow cylinders, the reinforcing lining being made of a material, the specific gravity of which is higher than that of the material of said hollow cylinders, a sound absorbing layer mounted to an interior surface of the layer of the reinforcing lining, said interior surface of the reinforcing lining being coaxial with the knob, and a sliding layer mounted to an interior surface of the sound absorbing layer, said interior surface of the sound absorbing layer being coaxial with the knob, the first hollow cylinder overlapping the hollow boss, the sliding layer being in contact with the external open end of the hollow boss so that the external open end of the hollow boss comprises the sound absorbing layer.

6. The platen knob as recited in claim 2, wherein the material for said reinforcing lining is selected from the group consisting of steel, lead and a synthetic resin including lead.

* * * * *